US006226874B1

(12) United States Patent
Jansson

(10) Patent No.: US 6,226,874 B1
(45) Date of Patent: May 8, 2001

(54) TOOL FOR THE CUTTING OR COINING OF METAL

(75) Inventor: Conny Jansson, Västerås (SE)

(73) Assignee: Kapman AB, Sandviken (SE)

( * ) Notice: Subject to any disclaimer, the term of this patent is extended or adjusted under 35 U.S.C. 154(b) by 0 days.

(21) Appl. No.: 09/506,907

(22) Filed: Feb. 18, 2000

(30) Foreign Application Priority Data

Feb. 25, 1999 (SE) ..... 9900656

(51) Int. Cl.[7] ..... B26B 17/02
(52) U.S. Cl. ..... 30/192; 30/252; 72/409.11
(58) Field of Search ..... 30/192, 252, 191, 30/245; 72/404.11; 81/355

(56) References Cited

U.S. PATENT DOCUMENTS

| | | | | |
|---|---|---|---|---|
| 2,073,460 | * | 3/1937 | Vosbikian et al. | 30/252 |
| 2,074,239 | * | 3/1937 | Rush | 30/252 |
| 2,382,292 | | 8/1945 | Carlson . | |
| 4,545,234 | * | 10/1985 | Schnellmann | 30/193 X |
| 5,014,432 | | 5/1991 | Putsch et al. . | |
| 5,081,769 | | 1/1992 | Juros . | |
| 5,101,566 | | 4/1992 | Crapo et al. . | |
| 5,898,998 | * | 5/1999 | Deville | 30/252 X |

FOREIGN PATENT DOCUMENTS

| | | |
|---|---|---|
| 2 744 660 | 8/1997 | (FR) . |
| 1 098 292 | 1/1968 | (GB) . |
| 311 265 | 6/1969 | (SE) . |
| 95/05271 | 9/1999 | (WO) . |

* cited by examiner

*Primary Examiner*—Douglas D. Watts
(74) *Attorney, Agent, or Firm*—Burns, Doane, Swecker & Mathis, L.L.P.

(57) ABSTRACT

A tool for the cutting or coining of metal, including two jaws connected to parallel links by two jaw joint bolts. Two handles are connected to each other by a handle bolt and are connected to respective jaws by two middle bolts. Each jaw joint bolt is provided with an eccentric bearing surface situated between two coaxial bearing surfaces. The distance and parallelism of the jaws can be adjusted by producing rotating of the eccentric bearing surface by rotating one or more of the jaw joint bolts. The angular motion of the jaws is synchronized by a cylindrical roller retained axially between the links, and guided in a slot formed by overlapped fingers of the jaws.

5 Claims, 2 Drawing Sheets

TOOL FOR THE CUTTING OR COINING OF METAL

BACKGROUND OF THE INVENTION

The present invention relates to tools for cutting or coining metal.

Bolt cutters are used for severing metal bars, such as bolts or reinforcement bars, and are normally provided with long handles for leverage. The cutting may also take the form of creating perforations in metal profiles. Similar tools are also used for the coining (shaping) of metal profiles. A tool of that type typically comprises two jaws held together at their centers by parallel links. The rear ends of the jaws are spaced apart and connected by hinges to the front ends of the handles. The handles are pivotably connected with each other in such a way that when the cutter is maximally open, a relatively small handle motion is enough to get a certain jaw-closing motion, but when the edges of the jaws almost touch each other at the end of a cutting operation, a greater handle motion is needed for the corresponding jaw motion. In this way there is achieved a strongly variable leverage, with the greatest force at the end of the operation when the jaws have penetrated the work material maximally.

The edges of the jaws become worn, and are easily damaged if one tries to cut a hardened bar, and it is therefore a requirement that a user shall be able to take the jaws apart for regrinding after some damage occurs. The hinges must thus be disconnectable and have a defined position so that the lengths of both edges rest against each other at the end of the cut. It is thus known to give the jaws a synchronized angular motion by a tangential connection against each other between the parallel links to get a defined closed position, such as shown in U.S. Pat. Nos. 5,081,769 and 5,101,566 and 5,014,432.

During regrinding, one must normally grind more at the tips of the jaws to make the edges touch along the whole edge length in a jaw-closed position, whereby the rear ends of the jaws get a greater distance from each other. To make the closed position of the handles coincide with the closed position of the jaws, the distance between the hinges of the handles can be made adjustable, such as by changing the handle distance with a screw as shown in U.S. Pat. Nos. 5,081,769 and 5,101,566.

It is also known to simplify regrinding by making the distance between the joints of the parallel links adjustable by using eccentric bolts such as disclosed in U.S. Pat. No. 5,081,769. The present invention concerns a design of the tangential connection between the jaws, which gives less play and a better defined closed position for the jaws compared to previously known designs, and which simplifies adjustment of the edges to a parallel relationship after regrinding.

SUMMARY OF THE INVENTION

The present invention relates to a tool for the cutting or coining of metal, the tool comprising two jaws pivotably connected to two parallel links by two respective jaw joint bolts, and two handles pivotably connected to each other by a handle bolt and pivotably connected to rear ends of the jaws by two respective middle bolts. At least one of the jaw joint bolts has coaxial bearing surfaces disposed in respective holes formed in the two links, and also has an eccentric bearing surface disposed in a hole formed in the one jaw. Each jaw is provided with at least two fingers overlapping respective fingers of the other jaw. The two fingers of each jaw are separated by a slot of uniform width. A cylindrical roller is located in both slots and has a diameter corresponding to the widths of the slots.

BRIEF DESCRIPTION OF THE DRAWINGS

The invention is described with reference to the figures, wherein.

DETAILED DESCRIPTION OF PREFERRED EMBODIMENTS OF THE INVENTION

Figure 1:
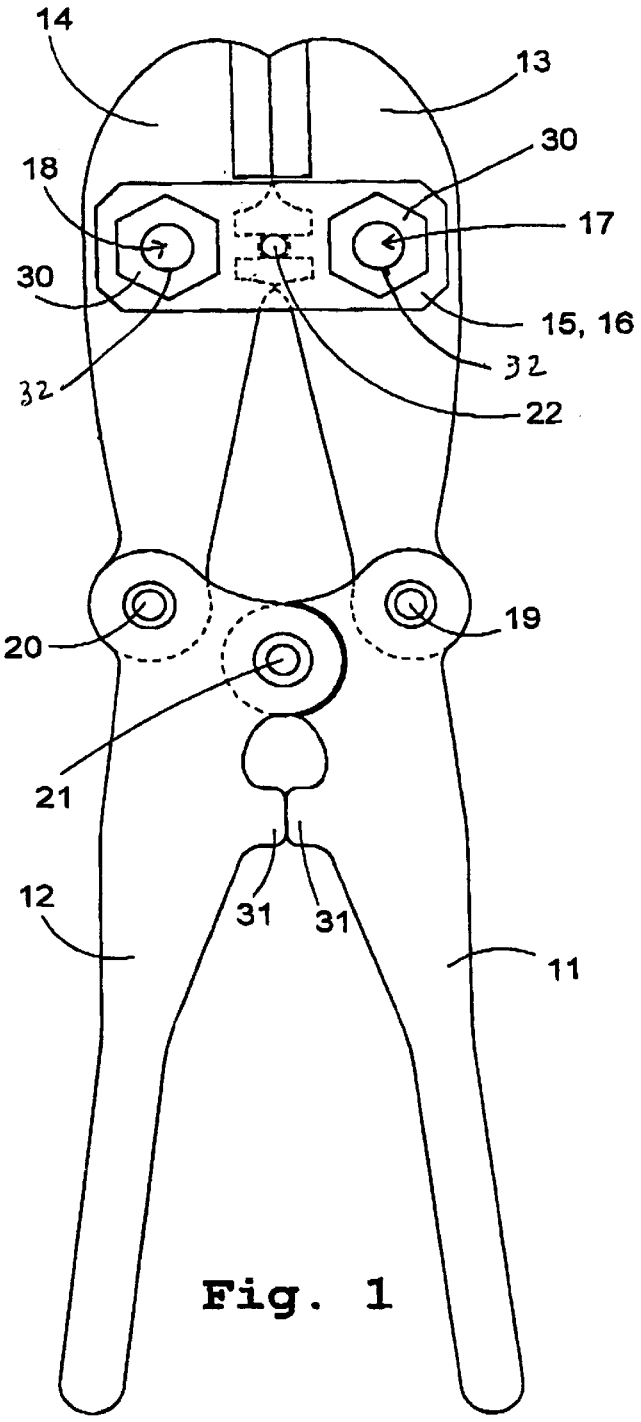
FIG. 1 shows a bolt cutter according to the invention.

A bolt cutter according to the invention comprises two handles (11, 12), two jaws (13, 14) and two parallel links (15, 16), only one link being visible in the drawings. The components are held together by two jaw joint bolts (17, 18), two middle bolts (19, 20) and one handle bolt (21). The relative position of the jaws is determined by a roller (22).

According to the invention, after being reground, the edges of the jaws can be adjusted to a parallel relationship by shortening the effective length of the links (15, 16) by an amount corresponding to the ground-off width of the jaw, in normal cases much less than 1 mm. Shortening of the links is made by rotating one or both jaw joint bolts (17,18) by a certain angle, as will become apparent.

At least one of the jaw joint bolts (17, 18) is provided with a bead (23), three cylindrical joint surfaces (24–26) and one thread (32). The largest (24) and the smallest (26) of the joint surfaces have the same central axis (i.e., are coaxial), while the intermediate joint surface (25) is eccentric (i.e. has an axis offset laterally with respect to the axis of joints (24, 26)). The largest and smallest joint surfaces (24, 26) fit in respective holes formed in the links (15, 16), and the intermediate joint surface (25) fits in a hole (33) formed in a respective jaw (13, 14). By the rotation of one jaw joint bolt, the axis of the intermediate joint surface (25) can be displaced by a distance which is, at most, twice as long as the distance (i.e., the eccentricity) between the axis of the intermediate joint surface (25) and the common axis of the other joint surfaces (24, 26). If that distance is 0.5 mm, for example, then the distance between the bolts (17, 18), i.e., the effective length of each link (15, 16), can be adjusted by 1.0 mm by adjusting one bolt, and can be adjusted by 2 mm by adjusting both bolts, which should be sufficient for all regrindings. Since the smallest joint surface (26) and the corresponding hole in one of the links have a smaller diameter than that of the intermediate bearing surface (25), further rotation of the bolt is avoided by tightening the bolt against the link with a nut (30).

To synchronize the angular motion and to give the jaws a defined longitudinal position it is known in the prior art to provide the mutually facing jaw sides with gear teeth as shown in U.S. Pat. No. 5,101,566, or with a convex cylindrical surface matching a concave surface as shown in U.S. Pat. No. 5,014,432, or with two concave cylindrical surfaces and one cylindrical roller as shown in U.S. Pat. No. 2,382,292. Those three designs all have the disadvantage that they suffer from play and lose their precision if the length of the parallel links is changed. It is therefore suggested in U.S. Pat. No. 5,081,769 to position an elastically expandable spring roller between two concave cylindrical surfaces. That design is only able to compensate for a small change in the length of the links, however, and can only transfer small tangential forces.

Figure 2:
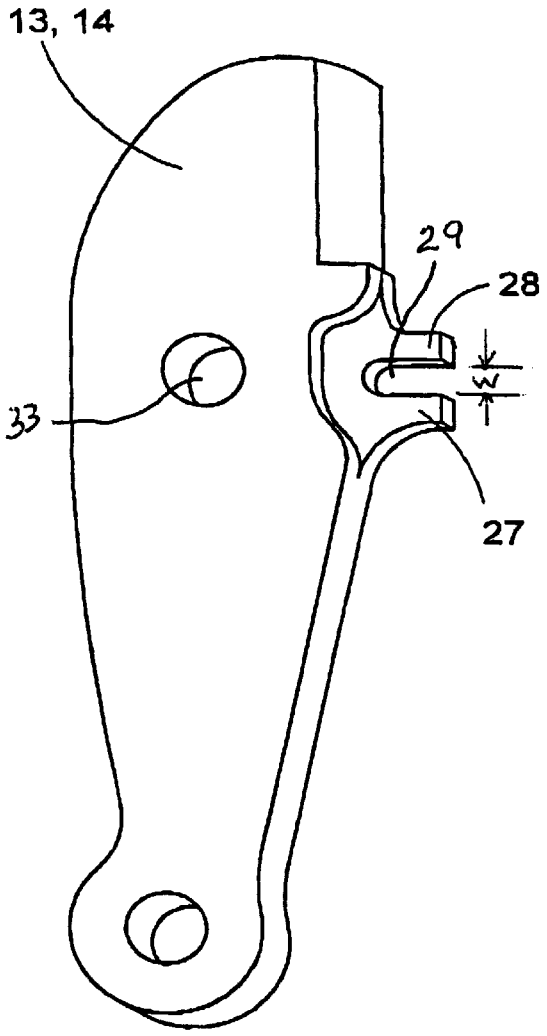
FIGS. 2 and 3 show different embodiments of a jaw.
Figure 3:
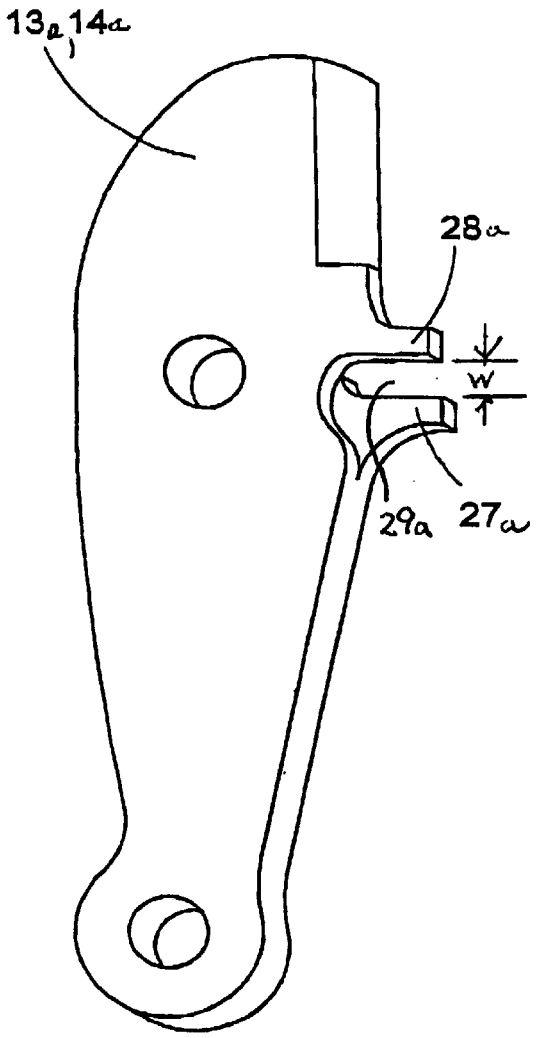

According to the invention, each of the jaws is provided with a pair of parallel fingers (27,28), each pair forming a slot (29) that is open at one end, i.e., the end facing the other slot. The fingers of one jaw extend towards, and overlap, respective fingers of the other jaw. The slots (29) thus cooperate (i.e., are superimposed) to form a single closed-ended slot of uniform width corresponding to the width W of the slots (29). A cylindrical roller (22) is located in the closed-ended slot, the roller having a diameter corresponding to the slot width and being axially retained by the links (15, 16). The fingers (27, 28) of each jaw can be located in the same plane as shown in FIG. 2. Alternatively, as shown in FIG. 3 the fingers 27*a*, 28*a* of each jaw (13*a*, 14*a*) can be located in different planes.

The jaws (13, 14) can be identically shaped, and the jaws (13*a*, 14*a*) can be identically shaped. The centerlines of the slots (29) preferably pass through the centers of the holes (33) for the jaw joint bolts as shown in FIGS. 2 and 3.

When the effective length of the parallel links (15, 16) is changed, the distance between the rear ends of the jaws will in general also be changed. Since the jaws are joined to the handles (11, 12) by the middle bolts (19, 20), this change might affect the closed position of the handles. However, it is desirable to keep the closed position of the handles as defined by the contact between the supporting lugs (31) of the handles, in order to avoid overstressing the cutting edges, and it is thus recommended to also adjust the distance between the middle bolt bearing surfaces to fit the distance between the jaw rear ends. While that could be done by elastical deformation of part of a handle by means of one or two screws as disclosed in U.S. Pat. No. 5,081,769 and French Patent 2 744 660, this has a tendency to make the whole motion too elastic and inexact, and may damage the part of the handle if the deformation is too large.

Figure 4:
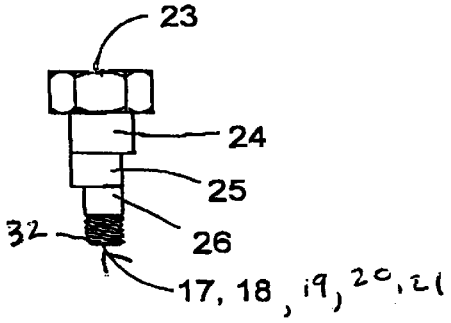
FIG. 4 shows an eccentric bolt.

According to the invention this rear adjustment can be made in the same manner done in as the front adjustment, i.e., at the parallel links (15, 16). That is, one or more of the middle bolts (19, 20) and the handle bolt (21) would be provided with coaxial bearing surfaces (24*a*, 26*a*) and an eccentric bearing surface (25*a*) in the same manner as shown in FIG. 4.

When a bolt cutter is assembled after regrinding, one or both jaw joint bolts (17, 18) is first adjusted to make the cutting edges parallel in the closed position. In bolt cutters, this normally is defined as occurring when the cutting edges touch each other. Secondly, one or more of the other bolts (19–21) is adjusted until the supporting lugs (31) touch each other in the closed position. A bolt cutter according to the invention can be made with integral or replaceable cutting edges. For bolt cutters in special cases, and for coining tools, the closed position may be differently defined, as by a certain edge distance, and the aim may be to adjust the tool to this distance. Coining tools may be designed to fasten fittings to cable ends, to join sheet metal parts or similar purposes.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. Tool for cutting or coining of metal, comprising two jaws pivotably connected to two parallel links by two respective jaw joint bolts, and two handles pivotably connected to each other by a handle bolt and pivotably connected to rear ends of the jaws by two respective middle bolts; at least one of the jaw joint bolts having coaxial bearing surfaces disposed in respective holes formed in the two links, and an eccentric bearing surface disposed in a hole formed in the one jaw; each jaw being provided with at least two fingers overlapping respective fingers of the other jaw to form a slot of uniform width, and a cylindrical roller located in the slot and having a diameter corresponding to the slot width.

2. Tool according to claim 1, wherein at least one of the middle bolts has coaxial bearing surfaces disposed in respective holes formed in the handles, and one eccentric bearing surface disposed in a hole formed in the jaw.

3. Tool according to claim 1, wherein the handle bolt has coaxial bearing surfaces disposed in respective holes formed in the handles, and one eccentric bearing surface disposed in a hole formed in the jaw.

4. Tool according to claim 1 wherein the jaws having edges for cutting of metal bars.

5. Tool according to claim 1 wherein the jaws are provided with coining shape elements.

* * * * *